US005926981A

United States Patent [19]

Theurer

[11] Patent Number: 5,926,981

[45] Date of Patent: Jul. 27, 1999

[54] TRACK WORK MACHINE FOR EXCAVATING MATERIAL FROM A TRACK BED

[75] Inventor: Josef Theurer, Vienna, Austria

[73] Assignee: Franz Plasser Bahnbaumaschinen-Industriegesellschaft m.b.H., Vienna, Austria

[21] Appl. No.: 08/889,982

[22] Filed: Jul. 10, 1997

[30] Foreign Application Priority Data

Aug. 14, 1996 [AT] Austria ..... 1470/96

[51] Int. Cl.[6] ..... E02F 5/22

[52] U.S. Cl. ..... 37/104; 104/2; 171/16

[58] Field of Search ..... 37/104, 105; 104/2; 171/16

[56] References Cited

U.S. PATENT DOCUMENTS 4,108,076 8/1978 Knape .
5,125,345 6/1992 Theurer et al. ..... 37/104 X
5,553,674 9/1996 Theurer et al. .
5,579,593 12/1996 Murray ..... 37/104
5,600,903 2/1997 McCray ..... 37/105 X
5,611,403 3/1997 Theurer et al. ..... 171/16

*Primary Examiner*—Heather Shackelford
*Attorney, Agent, or Firm*—Collard & Roe, P.C.

[57] ABSTRACT

A track work machine for excavating material from a bed supporting a track comprises a machine frame, undercarriages supporting the machine frame on the track for movement in an operating direction, a vertically adjustable endless excavating chain operable to be trained, and revolve, around the rails in a plane inclined relative to the longitudinal direction, and a ballast clearing device mounted on the machine frame between the undercarriages, the ballast clearing device comprising a carrier frame affixed to the machine frame, a vertically and transversely adjustable plate-shaped clearing tool, and drives for vertically adjusting the clearing tool over a distance of at least 65 cm between a raised rest position and an operating position wherein the clearing tool is immersed in a respective one of the cribs, and for adjusting the clearing tool transversely to the longitudinal direction.

5 Claims, 2 Drawing Sheets

TRACK WORK MACHINE FOR EXCAVATING MATERIAL FROM A TRACK BED

BACKGROUND OF THE INVENTION

1. Field of the Invention

The present invention relates to a track work machine for excavating material from a bed supporting a track comprised of ties defining cribs therebetween and rails fastened to the ties, which comprises a machine frame extending in a longitudinal direction, undercarriages supporting the machine frame on the track for movement in an operating direction, a vertically adjustable endless excavating chain operable to be trained, and revolve, around the rails in a plane inclined relative to the longitudinal direction, and a ballast clearing device mounted on the machine frame between the undercarriages, the ballast clearing device comprising a vertically and transversely adjustable clearing tool.

2. Description of the Prior Art

A track work machine of this general type has been disclosed in U.S. Pat. No. 4,108,076. To enable this machine to operate on a track-free section of the ballast bed, the machine frame carries caterpillar undercarriages. A ballast clearing device arranged immediately ahead of the endless excavating chain is comprised of two transversely spaced, vertically and transversely adjustable endless scraping chains revolving in a horizontal plane. The scraping chains enable the operating width of the excavating chain to be increased. As explained in the patent on top of column 5, before the start of the operation, a ditch must be dug in the ballast bed under the track, either manually or by some auxiliary equipment, to permit the previously opened endless excavating chain to be passed transversely under the track. This is cumbersome and delays the operation of the machine.

U.S. Pat. No. 5,553,674 also discloses a track work machine for excavating ballast from a track bed, which comprises a ballast clearing device immediately preceding an endless excavating chain. The ballast clearing device is comprised of a vertically and transversely adjustable suction pipe connected by a flexible suction hose to a vacuum device. In this way, the required ditch for insertion of the excavating chain under the track can be produced. The suction pipe is immersed in the ballast and a sufficient amount of ballast is aspirated to create the ditch.

SUMMARY OF THE INVENTION

It is the primary object of this invention to provide a track work machine of the first-indicated type, which enables the endless excavating chain to be rapidly inserted under the track with a relatively simple structure.

The above and other objects are accomplished in accordance with the invention with a ballast clearing device comprising a carrier frame affixed to the machine frame, a vertically and transversely adjustable plate-shaped clearing tool, and drives for vertically adjusting the clearing tool over a distance of at least 65 cm between a raised rest position and an operating position wherein the clearing tool is immersed in a respective one of the cribs, and for adjusting the clearing tool transversely to the longitudinal direction.

Such a ballast clearing device can be manufactured at relatively low cost and requires little space when mounted on the machine frame between the undercarriages while being capable of rapidly and efficiently producing a ditch required for the insertion of the transverse strand of the excavating chain under the track. Since such a ballast clearing device, with its clearing tools, vertical and transverse guides, and drives, is a simple structure and requires little space, it may be retrofitted on existing track work machines without any problems. These economic advantages enhance the incentive to use such a ballast clearing device for a short track bed excavating operation. It greatly facilitates the work for the operating crew and enhances their safety, particularly if there is continuing train traffic on a neighboring track.

The efficiency of the device may be readily maximized according to a preferred embodiment of the invention by arranging four clearing tools spaced from each other in a direction extending transversely to the longitudinal direction. Preferably, two distal clearing tools remote from a center of the track are pivotal about axes extending in the longitudinal direction.

BRIEF DESCRIPTION OF THE DRAWING

The above and other objects, advantages and features of the present invention will become more apparent from the following detailed description of certain now preferred embodiments, taken in conjunction with the accompanying somewhat schematic drawing wherein FIG. 1 a side elevational view of a ballast cleaning machine according to one embodiment of this invention.

DETAILED DESCRIPTION OF THE PREFERRED EMBODIMENTS

Figure 1:
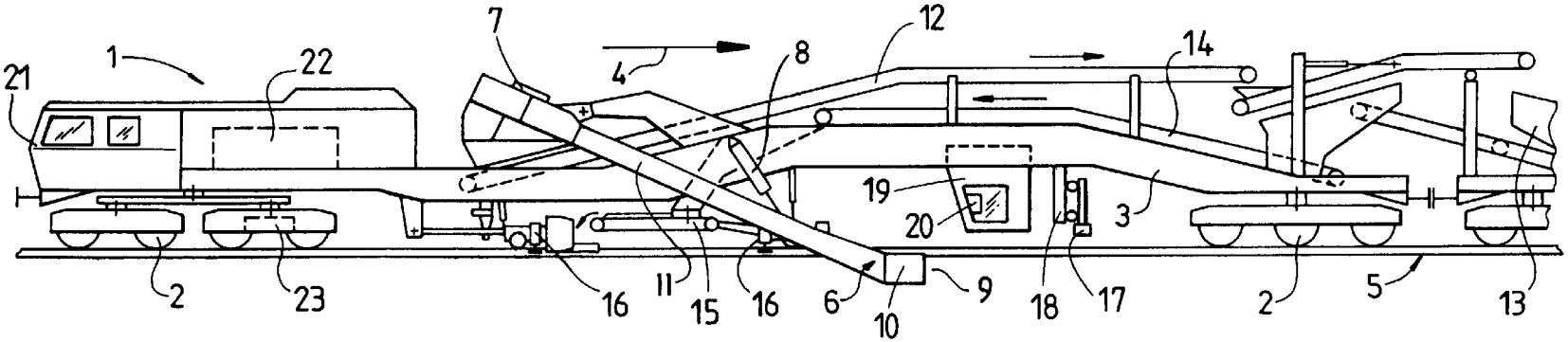

Referring now to the drawing, like reference numerals designate like parts operating in a like manner in all figures.

Figure 4:
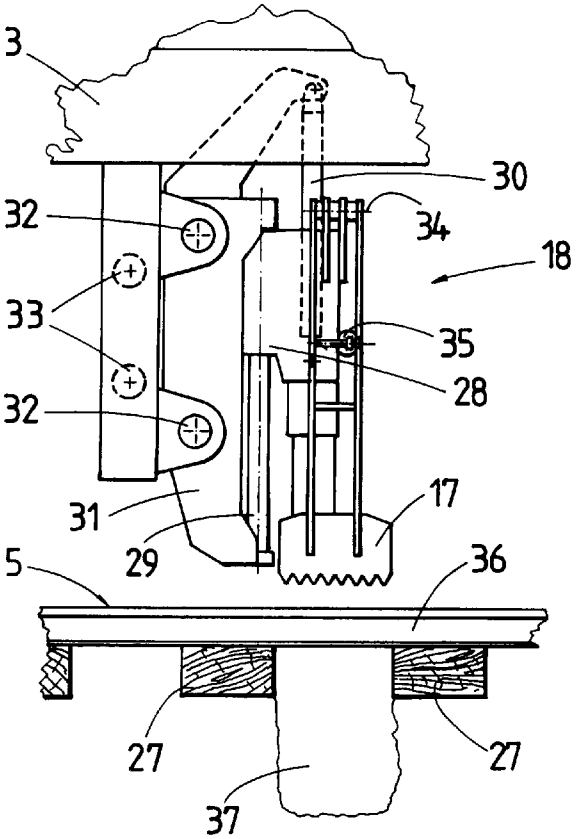
FIG. 4 is a fragmentary side elevational view of the ballast clearing device, taken in the direction of arrow IV in FIG. 3.
Figure 3:
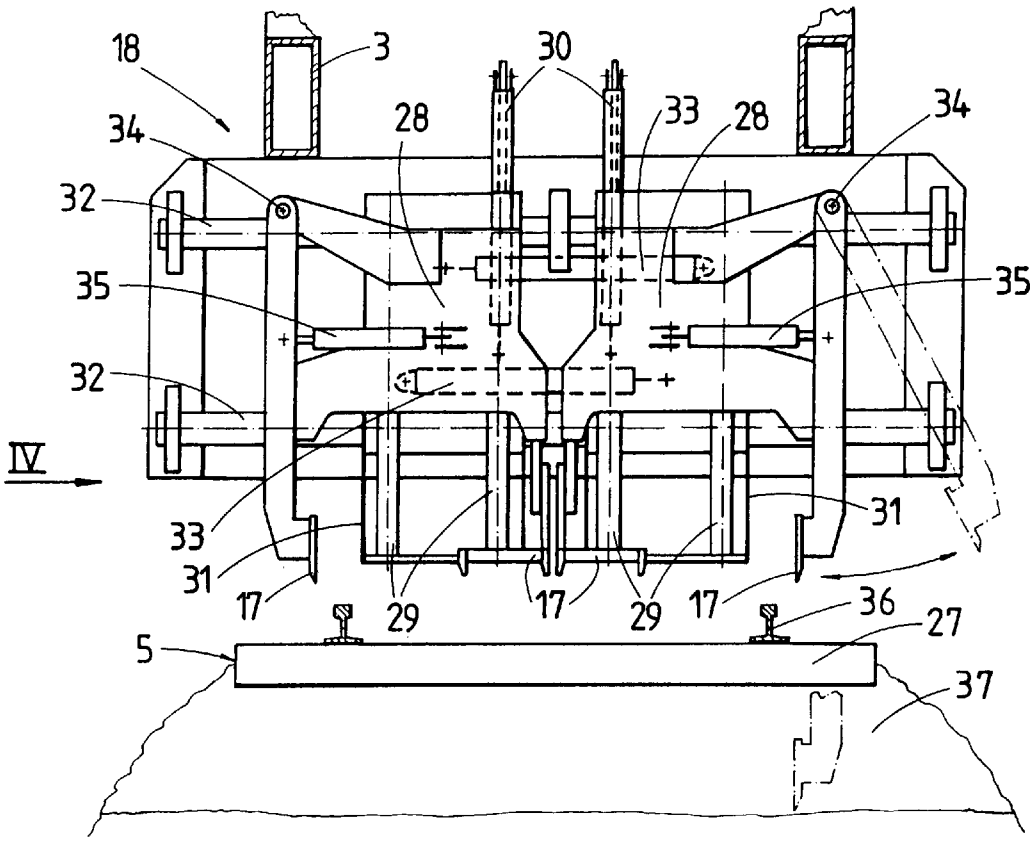
FIG. 3 is an enlarged end view of the ballast clearing device of the invention.

Referring first to FIGS. 1, 3 and 4, there is shown track work machine 1 for excavating material from a bed supporting track 5 comprised of ties 27 defining cribs 37 therebetween and rails 36 fastened to the ties. The illustrated track work machine is a ballast cleaning machine which comprises elongated machine frame 3 extending in a longitudinal direction and undercarriages 2 supporting the machine frame at its ends on track 5 for movement in an operating direction indicated by arrow 4. Vertically adjustable endless excavating chain 6 is mounted on machine frame 3 between undercarriages 2 and is operable to be trained, and revolve, around rails 36 in a plane inclined relative to the longitudinal direction. Drive 7 is arranged on a supporting guide frame for the excavating chain for revolving the endless chain and drives 8 link the supporting guide frame to the machine frame for vertically and laterally adjusting the excavating chain. In operation, strand 10 of endless excavating chain 6 extends perpendicularly to the longitudinal direction under track 5 at excavating site 9 to excavate the ballast under the track at this site and to convey the excavated ballast upwardly along the inclined plane in a longitudinal portion 11 of the supporting guide frame. The upwardly conveyed ballast is discharged at its highest point onto conveyor band arrangement 12, which conveys it to a schematically shown screening arrangement 13 where the excavated ballast is cleaned. The cleaned ballast is conveyed by conveyor band arrangement 14 from the screening arrangement to a discharge conveyor band 15 positioned directly above track 5 for discharging the cleaned ballast in the excavated portion of the track bed. Track lifting devices 16 are vertically adjustably mounted on machine frame 3 close to transverse excavating chain strand 10 and therebehind. Ballast cleaning machines of the described structure are well known and in wide commercial use so that the structural details and operation thereof require no detailed description.

Ballast clearing device 18 is mounted on machine frame 3 between the undercarriages 2, more particularly between endless excavating chain 6 and a front undercarriage 2, in the operating direction. The ballast clearing device will be described in detail hereinbelow in conjunction with FIGS. 3 and 4.

Operator's cab 19 housing central control panel 20 is arranged between ballast clearing device 18 and endless excavating chain 6. Driver's cab 21 is arranged at the rear end of machine 1 and another driver's cab is arranged at the front end of the machine (not shown). Motor 22 provides the energy for the operating drives of the various devices mounted on the machine, as well as for drive 23 which propels the machine along the track.

Figure 2:
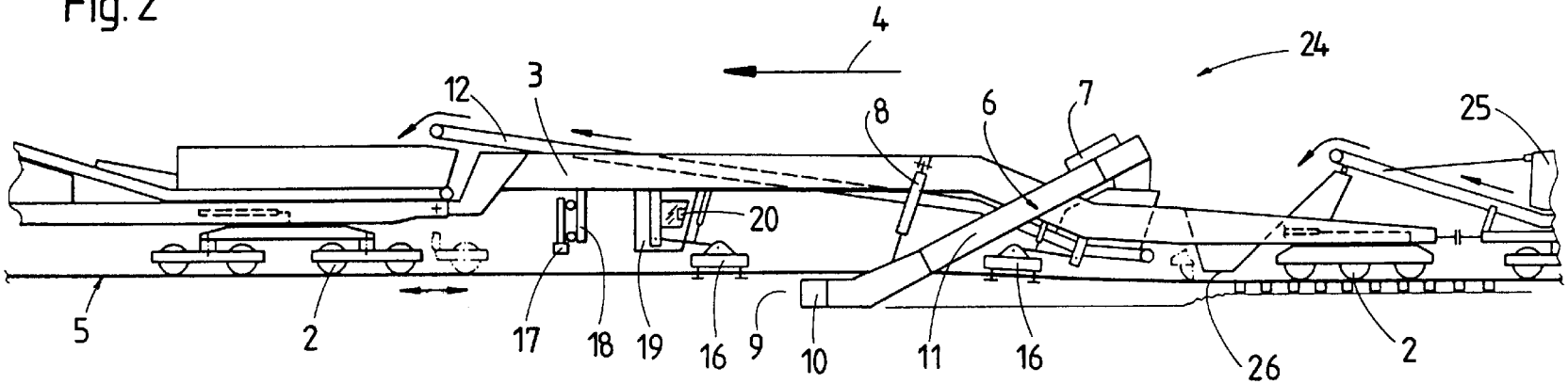
FIG. 2 is like view of another embodiment of a track work machine for producing a protective layer on the subgrade of the track bed.

FIG. 2 illustrates track work machine 24 comprising excavating chain 6 for excavating encrusted ballast which is removed by conveyor band 12 to a storage car preceding machine 24 in the operating direction and not shown in detail. At the same time, new ballast is continuously supplied from trailing storage car 25 and is discharged on the track bed through chute 26. Operator's cab 19 is preferably so arranged on machines 1 and 24 that an operator in the cab may be in a position to observe and control ballast clearing device 18 without leaving the cab.

As shown in FIGS. 3 and 4, ballast clearing device 18 comprises carrier frame 31 affixed to machine frame 3, vertically and transversely adjustable plate-shaped clearing tools 17, and drives 30, 33 for vertically adjusting the clearing tools over a distance of at least 65 cm between a raised rest position (shown in full lines) and an operating position (indicated in phantom lines) wherein clearing tools 17 are immersed in a respective one of cribs 37, and for adjusting the clearing tools transversely to the longitudinal direction. The minimum vertical adjustment of clearing tools 17 is required to remove sufficient ballast under ties 27 to form the transverse ditch needed for the insertion of transverse strand 10 of excavating chain 6 under track 5.

In the illustrated embodiment, ballast clearing device 18 comprises four clearing tools 17 spaced from each other in a direction extending transversely to the longitudinal direction, two distal clearing tools remote from a center of the track being pivotal about axes 34 extending in the longitudinal direction. Plate-shaped ballast clearing tools 17 extend in planes extending in the longitudinal direction, and their width is a little less than the width of the cribs, i.e. the distance between adjacent ties 27. Intermediate frames 28 are vertically adjustably mounted on horizontally and transversely displaceable carrier frame 31, and a respective pair of adjacent clearing tools 17 is mounted on a respective intermediate frame 28. Vertical guide columns 29 are mounted on carrier frame 31 and drives 30 vertically displace the intermediate frames while horizontally and transversely extending guide columns 32 are affixed to machine frame 3 and support carrier frame 31 for transverse displacement thereof. In addition, each intermediate frame 28 is transversely displaceable by a drive 33.

As shown in FIG. 3, each distal clearing tool 17 is pivotal by a drive 35 linking the clearing tool to intermediate frame 28 on which the clearing tool is mounted for pivoting about axis 34 on the intermediate frame between a vertical position (shown in full lines) and an outwardly extending position (shown in phantom lines). This enables the ballast moved outwardly by the clearing tool nearer the center of the track towards rail 36 to be pushed to the shoulder of the track bed.

In operation, clearing tools 17 are lowered by drives 30 into crib 37 from the position shown in full lines in FIG. 3 into a position shown in phantom lines, and they are transversely displaced by drives 33 until the center clearing tools are close to rails 36. At the same time, drives 35 may be actuated to pivot the distal clearing tools so that they may push the ballast moved outwardly by the center clearing tools further away towards the shoulders. After a transverse ditch has thus been excavated to a depth determined by the depth of immersion of the clearing tools in the ballast, the clearing tools are slightly raised and drives 33, 35 are actuated in an opposite direction to return the clearing tools to their initial position. The clearing tools are then again immersed in the remaining ballast and transversely displaced to remove more ballast, and this procedure is repeated until clearing tools 17 have been lowered to their maximum depth to complete the required transverse ditch. Transverse strand 10 of excavating chain 6 is then inserted in the transverse ditch and is connected to longitudinal strands 11 of the endless excavating chain. If the width of transverse strand 10 exceeds the distance between adjacent ties 27, it is useful to remove sufficient ballast from the adjacent crib down to the level of the undersides of the ties to enable the tie between the cribs to be slightly displaced after it has been detached from the rails.

What is claimed is:

1. A track work machine for excavating material from a bed supporting a track comprised of ties defining cribs therebetween and rails fastened to the ties, which comprises (a) a machine frame extending in a longitudinal direction, (b) undercarriages supporting the machine frame on the track for movement in an operating direction, (c) a vertically adjustable endless excavating chain operable to be trained, and revolve, around the rails in a plane inclined relative to the longitudinal direction, and (d) a ballast clearing device mounted on the machine frame between the undercarriages, the ballast clearing device comprising (1) a carrier frame affixed to the machine frame, (2) a vertically and transversely adjustable plate-shaped clearing tool, and (3) drives for vertically adjusting the clearing tool over a distance of at least 65 cm between a raised rest position and an operating position wherein the clearing tool is immersed in a respective one of the cribs, and for adjusting the clearing tool transversely to the longitudinal direction.

2. The track work machine of claim 1, wherein the ballast clearing device comprises four of said clearing tools spaced from each other in a direction extending transversely to the longitudinal direction, two distal ones of the four clearing tools remote from a center of the track being pivotal about axes extending in the longitudinal direction.

3. The track work machine of claim 1, wherein the ballast clearing device further comprises vertically adjustable intermediate frames, which are mounted on the horizontally and transversely displaceable carrier frame, and a respective pair of adjacent ones of the four clearing tools is mounted on a respective one of the intermediate frames.

4. The track work machine of claim 1, wherein the ballast clearing device is arranged between the endless excavating chain and a front one of the undercarriages, in the operating direction.

5. The track work machine of claim 4, further comprising an operator's cab arranged between the ballast clearing device and the endless excavating chain.

* * * * *